United States Patent [19]

Burgess

[11] Patent Number: 4,799,417

[45] Date of Patent: Jan. 24, 1989

[54] BRAIDED LINE

[75] Inventor: Paul D. Burgess, Hereford, Great Britain

[73] Assignee: Fly Fishing Technology Limited, Powys, Wales

[21] Appl. No.: 67,284

[22] Filed: Jun. 29, 1987

[30] Foreign Application Priority Data

Jun. 28, 1986 [GB] United Kingdom ..... 8615847

[51] Int. Cl.[4] ..... D04C 3/06; D04C 1/12

[52] U.S. Cl. ..... 87/11; 87/5; 87/20; 87/33; 87/41

[58] Field of Search ..... 87/5–8, 87/11, 18–20, 28–30, 33, 34, 41

[56] References Cited

U.S. PATENT DOCUMENTS

| | | | |
|---|---|---|---|
| 2,257,953 | 10/1941 | Haskell | 87/11 X |
| 2,388,693 | 11/1945 | Jeckel | 87/11 X |
| 2,407,929 | 9/1946 | Jeckel | 87/11 |
| 4,311,079 | 1/1982 | Hood | 87/30 X |

*Primary Examiner*—John Petrakes

*Attorney, Agent, or Firm*—Young & Thompson

[57] ABSTRACT

Braided line is manufactured by drawing off filaments (3) from a carousel of bobbins (1) which are caused to follow interweaving paths about a common axis. The line can be tapered by cutting selected filaments at intervals and continuing the braiding with a progressively reduced manner. Each cut off filament (14) leading from the braid point (8) is kept co-axially aligned by the air flow into a suction tube (6) within the carousel while the remaining filaments (3) are braided around it. The selection and cutting of the filaments can be automated, under computer control.

11 Claims, 1 Drawing Sheet

BRAIDED LINE

This invention relates to braided line, particularly fine line as used in fly fishing.

A fly fishing line normally has at its extremity a leader, this being a relatively short length which is transparent, which will either float or sink gradually having been given a controlled buoyancy, and which is preferably tapered towards the free end. Until recently these have been monofilament, but there is now a demand for the leader to be braided from fine filaments.

Braiding is a well established technique, long since mechanised. Generally, there a number of freely rotatable bobbins mounted with their axes vertical in an annular array, referred to herein as a carousel. They are driven so that half travel in one circumferential direction of the array and the other half travel in the opposite direction while, at the same time, each bobbin is made to follow a track which causes it to weave in and out of the bobbins coming in the opposite direction. The filaments are drawn upwardly from the bobbins and in towards a common point in a cone configuration. This point, referred to herein as the braid point, is co-axially aligned with the carousel and is sometimes defined by a fixed eye through which all the filaments lead. Above it the now braided line is led off to a take up spool, driven in synchronism with the carousel.

This produces uniform braided line. However, tapering such a line is a more difficult problem, and such apparatus has not hitherto been able to cope without extensive manual interference. Most braided leaders are produced entirely manually, the operator taking out filaments from time to time as the braiding progresses to achieve the taper. Apart from being time consuming and expensive, it also usually leaves a leader with several "whiskers" sticking out, where filaments have been cut off to create the taper.

It is the aim of this invention to adapt the known carousel type of machine outlined above to the manufacture of tapered line with minimal manual interference, at considerably greater speed that is possible by other techniques, and avoiding the exposed, cut off ends.

According to one aspect of the present invention there is provided apparatus for tapering braided lines comprising a braiding machine of the carousel type, and characterised by means for directing air flow in the vicinity of the braid point to cause severed filaments leading from that point to remain co-axially aligned with the carousel while being encased by the remaining filaments.

While this air flow could be generated by jets around the braid point, it is preferred to have a suction device with a mouth co-axially arranged adjacent the braid point.

It is further preferred to have means for sensing the braid point and for keeping the suction mouth substantially constant in relation to it while braiding is in progress. However, there may also be means for co-axially shifting the suction mouth away from the braid point when the carousel is stoppped to create a taper, the more easily to capture a filament after cutting.

When the carousel is so stopped, selected filaments can be cut manually. This may be appropriate where the taper is very gradual and the stopping of the carousel is infrequent, such as for tapering a complete braided fly line. However, for more sharply tapered lines, such as leaders, it will be preferred to have automatic cutting means for severing filaments between at least one bobbin and the braid point when the carousel is stopped to create a taper. This will generally entail means for identifying bobbin positions and for stopping the carousel with a selected bobbin in registry with the cutting means for severance of that bobbin's filament. It is important that, as tapering progresses, the cutting means is offered a filament that is still in the braiding process and not have a bobbin whose filament has already been cut stopped opposite it.

It will usually be advisable to have means for temporarily holding the filament to be severed below the cutting point while the cut is made. Also, there should be means for holding the portion of severed filament leading from any bobbin to the top of that bobbin while braiding continues.

According to another aspect of the present invention there is provided a method of tapering line while being braided characterised in that a carousel of bobbins is arrested at a predetermined position, a filament between a bobbin and the braid point is severed, the severed portion is led co-axially away from the braid point by directed air flow, and the braiding is resumed to encase the severed portion within the intertwined remaining filaments.

The sequence of events will conveniently by computer controlled. When tapering is to be commenced, the carousel will be slowed down according to a set program while a search is made for a designated bobbin. To identify this the carousel may have datum points for associated sensors to pick up and inform the computer of exact positions. The carousel can then be brought to a stop to hold the designated bobbin registering with the automatic cutting device. The latter is then operated and withdrawn and braiding is resumed, with the cut-off filaments leading from the braid point down into the suction device. This periodic cutting out of the filaments continues until the tapering reduces to its final limit and the final section is braided. The computer will then stop the carousel again for a new leader section to be commenced. This is done by drawing up all the previously cut of filaments temporarily held to the tops of their bobbins, and taking them around the braid point. When the machine is restarted, the restored filaments are incorporated again into the braiding, starting at the thicker end of a new leader. At present, this restart operation is done manually, but it is simple and quick and the computer can be arranged to call the operator to perform it.

Using computer control, it will be appreciated that variations in taper can easily be achieved. For example, instead of a uniform taper it might be desired to taper quickly over an early part of the leader section and then practically level out. Such changes may readily be accomplished by keying in instructions or changing a chip. There may also be an associated VDU to show the tapering in graphic form, and to illustrate current progress. But whatever the profile, the taper will be smoother than that obtained by the conventional abrupt cut-off; there is slight reduction when the cut filament is laid co-axially and a further slight reduction when the braidng passes its cut-off end.

Once the take-up spool is full with a line of leader sections, the latter will have to be cut to the appropriate length at the steps where the fresh tapers begin. Such steps are detectable, for example by a laser detector as the line is unwound past it, and this can be arranged to govern a downstream cutting device. The line might first be coated as described in our co-pending U.S. patent applications Nos. 8614452 and 8522769. Generally it will also be beneficial to heat the line under tension.

For a better understanding of the invention, one embodiment will now be described, by way of example, with reference to the accompanying drawing, in which.

In this example, the carousel has sixteen bobbins 1 in an annular array. They are caused to progress around the central vertical axis, half going in one direction and half in the other, weaving in and out of each other as described above.

Figure 1:
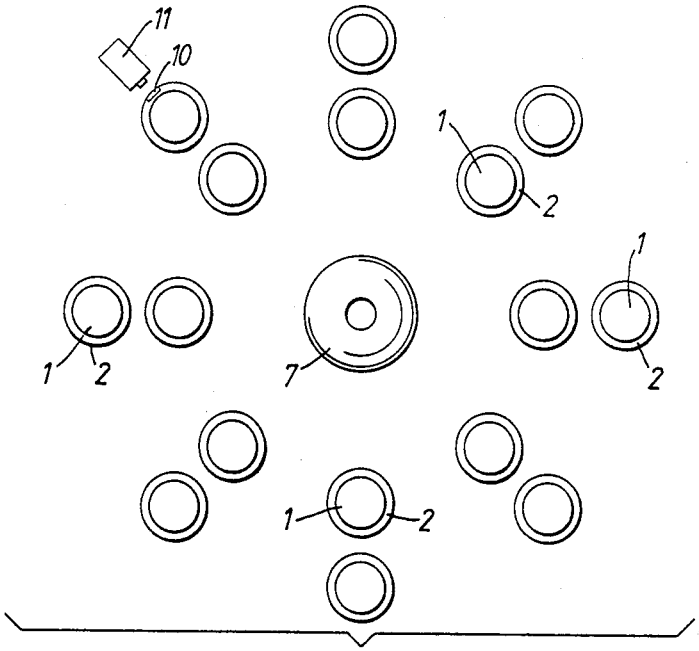
FIG. 1 is a diagrammatic plan view of a carousel of bobbins.
Figure 2:
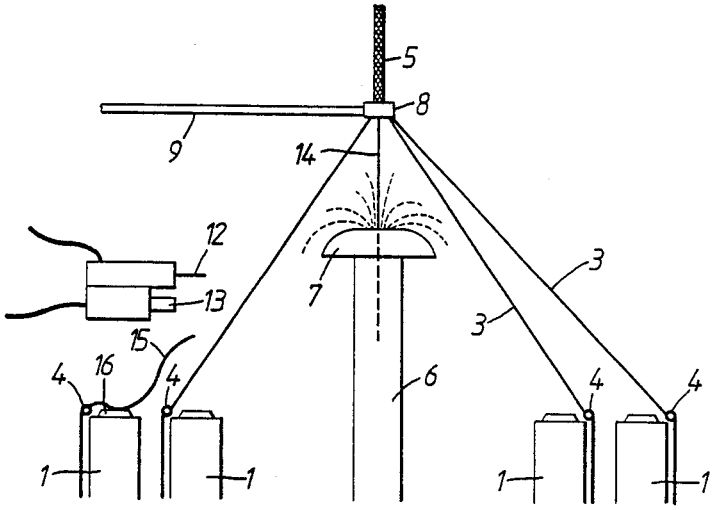
FIG. 2 is a side elevation showing the braid point above the carousel, a co-axial suction device, a cutting device and representative bobbins.

The bobbins 1 are freely rotatable on their respective mounts 2 about vertical axes, and the filaments 3 with which they are wound are led through a ring 4 at the top and thence in a coned arrangement to join at a braid point as shown in the upper part of FIG. 2. The interweaving produces a braided line 5 disappearing upwards, where it is wound onto a take-up spool (not shown). All this is an established technique and will not be described in more detail.

Co-axially arranged within the carousel 1 is a vertical suction tube 6 whose upper end has a mouth 7 which bells outwardly and is extended to turn back on itself to provide a smoothly curved rim. When air is drawn into this tube the airflow is smoothly convergent over this surface as indicated by broken lines. At the braid point, the filaments are led through a ring 8 on the end of a pivoted or floating arm 9. This ring rests on the apex of the coned filaments and as the braid point wanders slightly up and down, so the arm 9 will follow. This movement is sensed and the suction tube 6 is caused to follow it so that its mouth remains a constant distance below the braid point.

The bobbins 1, or at least their mounts 2, are identifiable. When tapering a braided line, it is important not to cut any old filament but a specified one (or possibly two or even more). Also, having cut one filament and taken that bobbin out of use, it is no good stopping the carousel at random, which may offer a non-existent filament to be cut again. Some other specified filament must be severed as the taper is continued. Such idenfification may be achieved in many ways, including providing each bobbin mount 2 with an individually coded signal generator. However, that is expensive, and it will be preferred to provide just one of the mounts 2 with a single datum point 10 which, as it passes a stationary sensor 11, generates a signal. This indicates to the computer control the instantaneous position of the carousel, which can then be brought to a halt with a specific bobbin at a desired position by counting on from the datum point.

Generally, the computer control will operate broadly on a time basis. That is, braiding with the maximum number of filaments will be carried out in a first defined period, at the end of which the carousel will be slowed down for recognition of the datum point and subsequent stopping for the first filament cut. Braiding will then be renewed for a second time period, and so on. However, it would also be possible to count the rotations of the carousel, and to cut filaments after so many revolutions.

Assuming that the desired bobbin has been stopped is registry with a cutting device 12, the latter is moved in under computer control to sever the filament between the braid point and the bobbin ring 4. At the same time the filament is trapped by pincers 13 below the cutting point to prevent it simply unwinding. The end portion 14 leading from the braid point, once free, is drawn over the mouth of the suction tube 6 and is aligned co-axially with it by the airflow. Initially, the tube will be a lowered position, but after cutting and the virtually instantaneous capture of the end portion 14, the tube 6 will be caused to rise, under computer control, until it reaches a predetermined height below the braid point. As braiding continues, the free length of the portion 14 will become shorter and it is desirable to keep its tip within the tube 6 for as long as possible.

The other free end portion 15 of the filament, leading from the bobbin ring 4, remains free, but a short distance back from its end it is held captive to the top of the bobbin. This could be done by a clip or other mechanical trapping device actuated by or in conjunction with the robot cutter 12 and pincers 13. This would nip the filament and hold the remaining end ready for the next cycle. Alternatively, and more simply, a tacky pad 16 is used, as shown in FIG. 2. After cutting, the pincers 13 press the filament down across the pad 16, release, and withdraw with the cutting device 12. The carousel is then restarted and the remaining filaments intertwine about the cut-off portion 14 and conceal it within.

Just before each new cut, the suction tube 6 is lowered, more easily to receive the next portion 14.

Instead of pincers 13, there may simply be a member which moves in with the cutter 12 and presses the filament onto the pad 16 to keep it taut as the severance is made. As the cutter is withdrawn so is the pressing member, leaving the filament end captive.

Instead of a sticky pad, a retentive fabric such as that known as "Velcro" may be suitable.

At the end of a tapered section, the carousel is stopped by the computer and the next section is begun by manually grasping the filament portions 15 from the disconnected bobbins, and adding them in at the braid point in the manner known for a broken filament.

I claim:

1. Apparatus for tapering braided lines comprising a braiding machine of the carousel type in which filaments converge from an annular array of bobbins on the carousel to a common braid point co-axial with the array, and in which opposed interweaving motion of the bobbins causes the filaments to form a braided line leading from the braid point, and including means for severing a filament between a bobbin and the braid point and means for directing air flow in the vicinity of the braid point generally co-axially of the array and away from the braid point so as to encase the severed portion leading from the braid point within the intertwined remaining filaments.

2. Apparatus according to claim 1, wherein the air directing means is a suction device with a mouth co-axialy arranged adjacent the braid point.

3. Apparatus according to claim 2, wherein there are means for sensing the braid point and keeping the mouth of the suction means substantially constant in relation to it while braiding is in progress.

4. Apparatus according to claim 3, wherein there are means for co-axially shifting the mouth of the suction means away from the braid point when the carousel is stopped to create a taper.

5. Apparatus according to claim 1, wherein the means for severing comprises automatic cutting means for severing filaments between at least one selected bobbin and the braid point when the carousel is stopped to create a taper.

6. Apparatus according to claim 5, wherein there are means for identifying bobbin positions and for stopping the carousel with a selected bobbin in registry with said cutting means for severance of that bobbin's filament.

7. Apparatus according to claim 5, wherein there are means for temporarily holding the filament to be severed below the cutting point while the cut is made.

8. Apparatus according to claim 1, wherein there are means for holding the portion of severed filament leading from any bobbin to the top of that bobbin while braiding continues.

9. A method of tapering line while being braided, comprising leading filaments from bobbins in an annular array on a carousel convergently to a common braid point co-axial with that array, driving the bobbins with opposed interweaving motion to cause the filaments to form a braided line leading from the braid point, arresting said motion at a predetermined position, severing a filament between a bobbin and the braid point, applying directed air flow in the vicinity of the braid point generally co-axially of the array and away from the braided line, and resuming said motion to continue braiding while the air flow is maintained to encase the severed portion leading from the braid point within the intertwined remaining filaments.

10. A method according to claim 9, wherein the directed air flow is created by a suction tube mounted co-axially of the carousel.

11. A method according to claim 9, wherein the position of the braid point is sensed and the mouth of the suction tube is kept substantially constant in relation to it while braiding is in progress.

* * * * *